US012331985B2

(12) United States Patent
Vellinga

(10) Patent No.: US 12,331,985 B2
(45) Date of Patent: Jun. 17, 2025

(54) REFRIGERATOR

(71) Applicant: Horeca Engineering B.V., Harlingen (NL)

(72) Inventor: Willem Jan Vellinga, Harlingen (NL)

(73) Assignee: Horeca Engineering B.V., Harlingen (NL)

( * ) Notice: Subject to any disclaimer, the term of this patent is extended or adjusted under 35 U.S.C. 154(b) by 91 days.

(21) Appl. No.: 18/010,247

(22) PCT Filed: Jun. 14, 2021

(86) PCT No.: PCT/EP2021/065979
§ 371 (c)(1),
(2) Date: Dec. 14, 2022

(87) PCT Pub. No.: WO2021/254966
PCT Pub. Date: Dec. 23, 2021

(65) Prior Publication Data

US 2023/0266048 A1 Aug. 24, 2023

(30) Foreign Application Priority Data

Jun. 15, 2020 (EP) ..... 20180015

(51) Int. Cl.
*F25D 23/02* (2006.01)
*F25D 23/08* (2006.01)

(52) U.S. Cl.
CPC ..... *F25D 23/028* (2013.01); *F25D 23/087* (2013.01)

(58) Field of Classification Search
CPC ..... F25D 23/087; F25D 23/028; F25D 21/04; F25D 23/02; F25D 23/082; F25D 2400/06; F25D 2201/126; F25D 23/085
See application file for complete search history.

(56) References Cited

U.S. PATENT DOCUMENTS 3,400,964 A * 9/1968 Baermann ..... F25D 23/087 49/478.1
3,635,536 A * 1/1972 Lackey ..... F25D 23/062 312/405
4,617,759 A 10/1986 Pasqualini et al.
(Continued)

FOREIGN PATENT DOCUMENTS

CN 203163393 U 8/2013
CN 203672025 U * 6/2014
(Continued)

*Primary Examiner* — Hiwot E Tefera
(74) *Attorney, Agent, or Firm* — The Webb Law Firm

(57) ABSTRACT

The invention relates to a refrigerator having a housing with at least one door frame defining a door opening for access to the housing and having a sealing surface, at least one door for closing the door opening defined by the at least one door frame, and sealing means arranged between the at least one door and the at least one door frame for sealing the door opening in the closed position of the at least one door. The sealing means include a sealing frame mounted on one of the at least one door and the at least one door frame, and magnetic means for urging the sealing frame in contact with a contact surface provided at the other of the at least one door and the at least one door frame. The sealing frame is form retaining in the open position, during opening, during closing, and in the closed position of the at least one door.

10 Claims, 2 Drawing Sheets

(56) References Cited

U.S. PATENT DOCUMENTS

| | | | | | |
|---|---|---|---|---|---|
| 4,852,303 | A * | 8/1989 | Rolek | F25D 23/082 | 49/478.1 |
| 4,891,912 | A * | 1/1990 | Bockwinkel | F25D 23/082 | 49/478.1 |
| 4,998,382 | A | 3/1991 | Kostos et al. | | |
| 5,487,239 | A * | 1/1996 | Jenkins | F25D 23/087 | 312/405 |
| 5,916,076 | A | 6/1999 | Cittadini et al. | | |
| 5,934,098 | A * | 8/1999 | Lee | E05C 19/161 | 62/298 |
| 10,563,905 | B1 * | 2/2020 | Allard | F25D 23/085 | |
| 2002/0041134 | A1 * | 4/2002 | Wolf | F25D 23/062 | 312/400 |
| 2014/0047775 | A1 * | 2/2014 | Litch | E05C 19/161 | 49/489.1 |
| 2018/0073800 | A1 * | 3/2018 | Okazaki | F25D 23/08 | |
| 2023/0086468 | A1 * | 3/2023 | Lanzl | F25D 21/04 | |

FOREIGN PATENT DOCUMENTS

| | | | |
|---|---|---|---|
| CN | 206369390 | U | 8/2017 |
| CN | 208254056 | U | 12/2018 |
| CN | 109723349 | A | 5/2019 |
| EP | 0705415 | B1 | 11/1998 |
| KR | 910003559 | Y1 * | 5/1991 |
| KR | 100234991 | B1 * | 12/1999 |
| WO | WO-2017102013 | A1 * | 6/2017 |

* cited by examiner

REFRIGERATOR

CROSS REFERENCE TO RELATED APPLICATIONS

This application is the United States national phase of International Patent Application No. PCT/EP2021/065979 filed Jun. 14, 2021, and claims priority to European Patent Application No. 20180015.8 filed Jun. 15, 2020, the disclosures of which are hereby incorporated by reference in their entireties.

BACKGROUND OF THE INVENTION

Field of the Invention

The invention relates to a refrigerator comprising:

a housing with at least one door frame defining a door opening for access to the housing and having a sealing surface;

at least one door for closing the door opening defined by the at least one door frame; and sealing means arranged between the at least one door and the at least one door frame for sealing the door opening in the closed position of the at least one door;

wherein the sealing means comprise a sealing frame mounted on one of the at least one door and the at least one door frame, and magnetic means for urging the sealing frame in contact with a contact surface provided at the other of the at least one door and the at least one door frame.

Description of Related Art

Typically the sealing means of refrigerators are composed out of a rubber strip profile, which has a portion similar to bellows to allow for compression and expansion of the rubber strip profile in a direction perpendicular to the longitudinal direction of the profile. Furthermore, a strip of magnetic material is inserted into the rubber strip profile.

Such a rubber strip profile is mounted onto the door of the refrigerator. The door of the refrigerator could be a hinged door or a door arranged on a drawer.

Health and safety regulations require that refrigerators used in commercial settings have undamaged sealing means, because damaged seals cannot be cleaned properly and increase the risk of growth of bacteria.

Those health and safety regulations also require, that refrigerators are thoroughly cleaned, which also includes cleaning of the rubber strip profile. Such frequent cleaning could cause damage of the rubber profile.

Also the frequent use the refrigerator in commercial setting causes a rapid decay of the rubber profile, which is intensified by the vacuum effect occurring in a refrigerator, when it is opened and closed too frequently. This vacuum effect causes the rubber strip profile to be expanded extremely, which could lead to rupture of the rubber profile.

SUMMARY OF THE INVENTION

It is an object of the invention to reduce or even remove the above mentioned disadvantages.

This object is achieved with a refrigerator according to the preamble, which is characterized in that the sealing frame is form retaining in the open position, during opening, during closing and in the closed position of the at least one door.

In contrast to prior art refrigerators in which the rubber strip profile provides a maximal flexibility and compressibility for the sealing means, the refrigerator according to the invention has a sealing frame which is form retaining and is in normal use of the refrigerator not flexible or compressible.

The magnetic means urge the sealing frame in contact with the contact surface, such that the at least one door is sealed on to the at least one door frame. As the sealing frame is form retaining, there will be no deformation, compression, expansion or stretching of the sealing frame during normal use of the refrigerator, i.e. in the open position, during opening, during closing and in the closed position of the at least one door. This ensures that the sealing frame of the invention is more wear resistant than the prior art rubber strip profiles. Due to the form retaining features, the sealing frame can also be cleaned more quickly and thoroughly as it will not bend or flex away when being cleaned.

In a preferred embodiment of the refrigerator according to the invention the sealing frame is a solid body, preferably a solid nylon body. A solid body ensures sufficient rigidity to any forces exerted onto the sealing frame. Even if the solid body would wear out, then still the chance of any cracks occurring is small and the need to frequently replace the sealing frame is avoided.

In another embodiment of the refrigerator according to the invention the magnetic means comprise one or more magnets and one or more bodies of a magnetizable material, in particular iron, wherein the one or more magnets are embedded in one of the sealing frame and the contact surface and wherein the one or more bodies are embedded in the other of the sealing frame and the contact surface.

The magnetic means ensure that the sealing frame achieves an optimal contact with the contact surface, such that an optimal sealing of the door with respect to the door frame is obtained.

By embedding the bodies of magnetizable material and the magnets into the sealing frame and contact surface, the bodies and the magnets could be in close proximity of each other, when the door is in the closed position. As a result an optimal attraction of the magnets onto the bodies of magnetizable material is obtained. Preferably, the magnets are neodymium magnets.

In a further preferred embodiment of the refrigerator according to the invention the contact surface is formed by stainless steel sheet material and the one or more bodies of magnetizable material is laminated on the stainless steel sheet material opposite of the contact surface.

Typically refrigerators in commercial setting are lined on the outside with stainless steel sheet material. As stainless steel is not magnetizable, a body of magnetizable material can be laminated onto the stainless steel sheet material, such that the magnets can still exert an attraction onto the magnetizable material and ensure a good contact between the sealing frame and the contact surface.

In yet another embodiment of the refrigerator according to the invention the sealing frame is mounted onto the at least one door and wherein the sealing frame encloses an opening equally sized as the door opening.

BRIEF DESCRIPTION OF THE DRAWINGS

These and other features of the invention will be elucidated in conjunction with the accompanying drawings.

DESCRIPTION OF THE INVENTION

Figure 1:
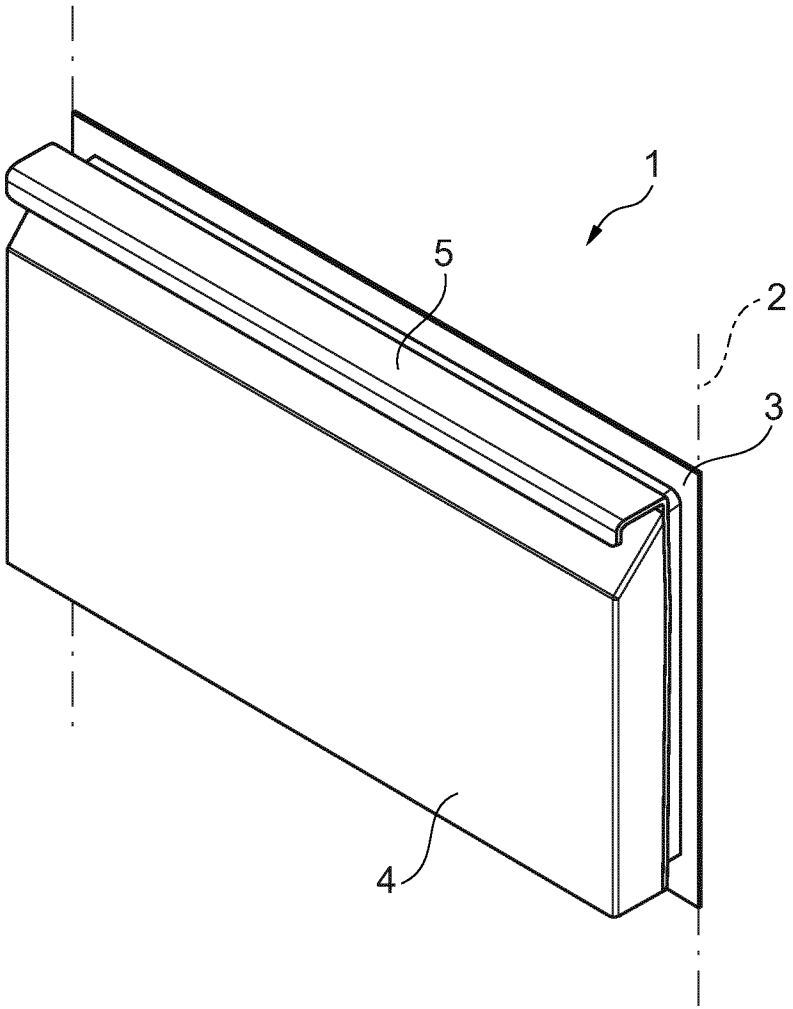
FIG. 1 shows a perspective view of part of an embodiment of a refrigerator according to the invention.

FIG. 1 shows part of a refrigerator 1, in particular a housing 2 with a door frame 3 and a door 4. The door 4 is of a drawer arranged in the housing 2 and provided with a handle 5 at the top of the door 4.

Figure 2:
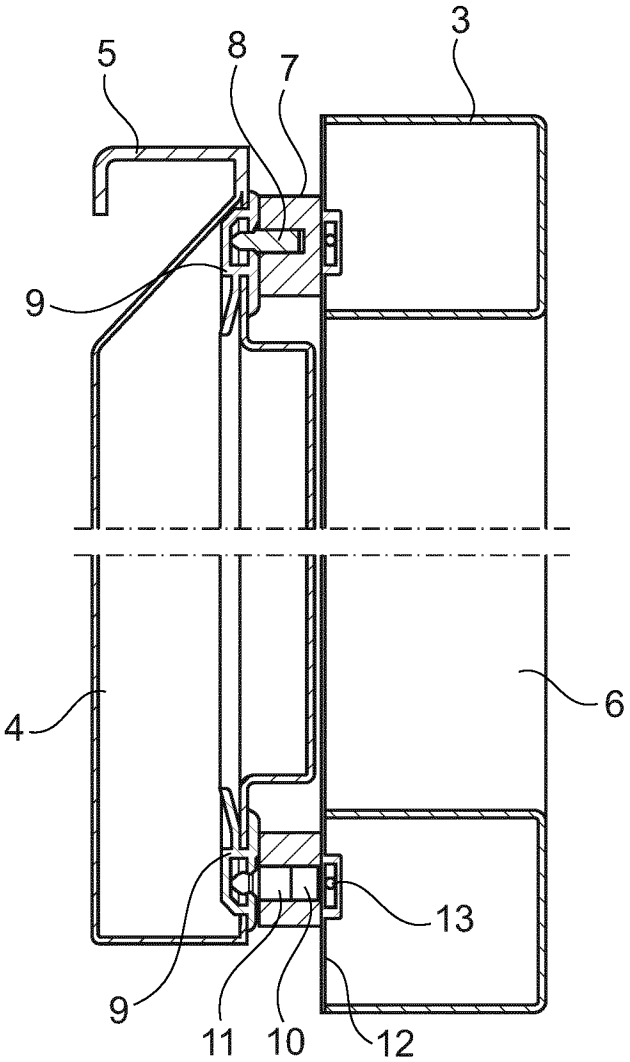
FIG. 2 shows a cross-sectional view of FIG. 1.

FIG. 2 shows a cross-sectional view of FIG. 1. The door frame 3 defines a door opening 6, which is closed off by the door 4. The door 4 is provided with a sealing frame 7 of a form retaining material, preferably nylon. The sealing frame 7 is mounted by mounting plugs 8 and a mounting profile 9 to the door 4.

A number of magnets 10 are embedded at discrete positions along the circumference in the sealing frame 7 in a respective pocket hole 11. (see also FIG. 3).

The housing 2 of the refrigerator 1 is typically lined with stainless steel sheet material 12. As stainless steel is not a magnetizable material, a body 13 of magnetizable material, in particular iron, is arranged on the inside of the housing 2 and aligned with the magnet 10 for optimal attraction.

Figure 3:
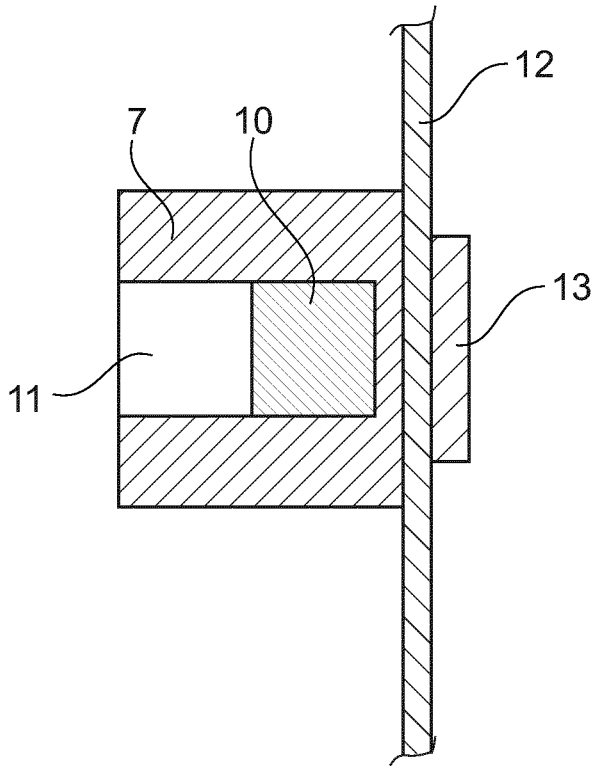
FIG. 3 shows the sealing frame of FIG. 2 in more detail.

As shown in FIG. 3 in more detail, the pocket hole 11 extends into the sealing frame 7 from the side opposite of the side, which contacts the door frame 3 and in particular the stainless steel sheet material 12. This ensures that the sealing frame 7 has a surface without interruptions, which ensures a good sealing of the sealing frame 7 onto the door frame 3.

The invention claimed is:

1. A refrigerator comprising:

a housing with at least one door frame defining a door opening for access to the housing and having a sealing surface;

at least one door for closing the door opening defined by the at least one door frame; and sealing means arranged between the at least one door and the at least one door frame for sealing the door opening in the closed position of the at least one door;

wherein the sealing means comprise a sealing frame secured directly and immovably to the at least one door, and magnetic means for urging the sealing frame in contact with a contact surface provided at the at least one door frame, wherein the sealing frame is form retaining in the open position, during opening, during closing and in the closed position of the at least one door, wherein as form retaining, there will be no deformation, compression, expansion, or stretching of the sealing frame during normal use of the refrigerator, and wherein the magnetic means comprise one or more magnets and one or more bodies of a magnetizable material, wherein the one or more magnets are embedded in one of the sealing frame and the contact surface, and wherein the one or more bodies are embedded in the other of the sealing frame and the contact surface.

2. The refrigerator according to claim 1, wherein the sealing frame is a solid body.

3. The refrigerator according to claim 1, wherein the magnetizable material is iron.

4. The refrigerator according to claim 1, wherein the contact surface is formed by stainless steel sheet material and wherein the one or more bodies of magnetizable material is laminated on the stainless steel sheet material opposite of the contact surface.

5. The refrigerator according to claim 1, wherein the sealing frame is mounted onto the at least one door and wherein the sealing frame encloses an opening equally sized as the door opening.

6. The refrigerator according to claim 2, wherein the contact surface is formed by stainless steel sheet material and wherein the magnetic means is laminated on the stainless steel sheet material opposite of the contact surface.

7. The refrigerator according to claim 2, wherein the sealing frame is mounted onto the at least one door and wherein the sealing frame encloses an opening equally sized as the door opening.

8. The refrigerator according to claim 4, wherein the sealing frame is mounted onto the at least one door and wherein the sealing frame encloses an opening equally sized as the door opening.

9. The refrigerator according to claim 6, wherein the sealing frame is mounted onto the at least one door and wherein the sealing frame encloses an opening equally sized as the door opening.

10. The refrigerator according to claim 2, wherein the sealing frame is a solid nylon body.

* * * * *